US012274338B1

(12) United States Patent
Sturm

(10) Patent No.: US 12,274,338 B1
(45) Date of Patent: Apr. 15, 2025

(54) CARRIER WITH MAGNETIC CLOSURE SYSTEM

(71) Applicant: Think Tank Photo, Inc., Santa Rosa, CA (US)

(72) Inventor: Michael Allen Sturm, Redding, CA (US)

(73) Assignee: Think Tank Photo, Inc., Santa Rosa, CA (US)

( * ) Notice: Subject to any disclaimer, the term of this patent is extended or adjusted under 35 U.S.C. 154(b) by 243 days.

(21) Appl. No.: 17/878,027

(22) Filed: Jul. 31, 2022

Related U.S. Application Data

(60) Provisional application No. 63/228,082, filed on Jul. 31, 2021.

(51) Int. Cl.
*A45C 13/10* (2006.01)
*A45C 13/00* (2006.01)

(52) U.S. Cl.
CPC ..... *A45C 13/1069* (2013.01); *A45C 13/005* (2013.01); *A45C 13/103* (2013.01); *A45C 2013/1015* (2013.01)

(58) Field of Classification Search
CPC .. A45C 13/1069; A45C 13/005; A45C 13/103
USPC ..... 224/183
See application file for complete search history.

(56) References Cited

U.S. PATENT DOCUMENTS

| | | | | |
|---|---|---|---|---|
| 4,921,151 | A * | 5/1990 | Duvall | B62J 9/27 190/125 |
| 8,720,681 | B1 * | 5/2014 | Hancock | A45C 13/1069 224/183 |
| 9,265,318 | B1 * | 2/2016 | Williams | A45C 11/20 |
| 9,526,309 | B2 * | 12/2016 | Huyke-Phillips | A45C 11/16 |
| 10,893,713 | B2 * | 1/2021 | Popoca Perez | A41F 9/002 |
| 11,076,666 | B2 * | 8/2021 | Sullivan | A45C 13/008 |
| 2003/0141160 | A1 * | 7/2003 | Schlipper | A45C 13/20 190/125 |
| 2007/0193902 | A1 * | 8/2007 | Myers | A45C 13/1069 206/320 |
| 2008/0296325 | A1 * | 12/2008 | Tepper | A45F 5/00 224/148.6 |
| 2017/0119116 | A1 * | 5/2017 | Bradley | A45C 13/36 |
| 2018/0252458 | A1 * | 9/2018 | Furneaux | A45C 5/06 |

* cited by examiner

*Primary Examiner* — Nathan J Newhouse
*Assistant Examiner* — Lester L Vanterpool
(74) *Attorney, Agent, or Firm* — R. Dabney Eastham

(57) ABSTRACT

A carrier such as a belt bag, shoulder bag, or backpack is provided with a lid that reversibly secures an opening in the walls of the carrier at a top end of the carrier using paired and attracting magnets mounted in stiffening strips located along edges of the lids and along the edges of the openings in the carrier.

19 Claims, 8 Drawing Sheets

CARRIER WITH MAGNETIC CLOSURE SYSTEM

CROSS-REFERENCE TO RELATED APPLICATIONS

This non-provisional application claims benefit and priority under 35 U.S.C. § 119(e) of U.S. provisional patent application Ser. No. 63/228,082 filed on 31 Jul. 2021 and titled "Carrier with Magnetic Closure System," the contents of which are incorporated by reference for all purposes.

BACKGROUND OF THE INVENTION

The field of the invention is that of carriers for articles.

Carriers for articles such as belt bags or waist bags, backpacks, shoulder bags, cases, and the like have walls defining one or more internal compartments. The user of the carrier accesses the internal compartment(s) through an opening defined in the walls of the carrier. Access through the opening may be controlled by a variety of means to close the opening, such as a drawstring closure, one or more zippers, and mating hook and loop tape. Alternatively, a door or lid may be removeably secured across the opening. The door or lid may be detachable from the walls or hinged to one or more of the walls.

In backpacks a top opening of the backpack may be drawn shut by a drawstring while an upper lid defining a pocket is secured over the opening with buckles. The upper lid may define a pocket for carrying articles. In some backpacks one edge of the upper lid is rotatably hinged to one of the walls of the backpack (usually the back-contacting wall) and an opposed side of the upper lid is secured to an opposed wall (usually the front wall) of the backpack with buckles or hooks. Alternatively, the edges of the upper lid that are not connected to a wall of the backpack by a hinge may be detachably connected to one or more of the other walls of the backpack by a zipper or by hook and loop tape connections.

Belt packs usually have a top lid. The top lid usually is hinged to a side wall opposed to a wall that is in contact with the body of a user so that the top lid can be flipped or rotated away from the user for access to articles contained in an interior compartment of the belt pack. The top lid may be removeably secured to the side walls of the belt pack by a zipper or buckle or mating hook and loop tapes except for the part or edge of the top lid that is hinged to the side wall opposed to the body contacting wall. Shoulder bags may have a similar structure.

Unlocking buckles, unfastening zippers, and separating hook tapes from loop tapes in order to release a top lid to hinge away from the opening requires some dexterity and takes some time. In addition, these actions may make noise. This is especially the case for separating a hook tape from a loop tape. For some purposes, such as photography in which quick access to cameras and other photographic gear may be desirable in order to take advantage of a fleeting moment for a picture, quick and easy opening of the top lid is beneficial. In addition, making noise when opening the top lid is usually undesirable. At the same time, however, the top lid should remain attached to the rest of the carrier when access to articles in the internal compartment is no longer desired, because of the need to protect the articles from dust and wet as well as to secure the articles inside the internal compartment.

Accordingly, for some purposes such as photography, quick and easy movement of the top lid between closed and shut positions is very beneficial. Preferably the movement should be accomplished without much finagling or fine movement of the hands and should be relatively noiseless.

Before the filing of the provisional application from which this non-provisional application claims priority, Badlands Gear Co. LLC, a Delaware limited liability company with a main office in Sandy, Utah was selling pouches for holding hunting gear such as rangefinders or binoculars that incorporate the "Zip-No™ magnetic closure system technology." This system uses magnets to secure the opening to the internal compartment of a pouch. The products using this magnetic closure system include the Bino D Mag and Mag Bino Case for binoculars and the Mag Rangefinder Case for rangefinders. These cases are pouches made of fabric that have clamshell openings in which the pouch is hinged at the bottom so that the two halves of the pouch can rotate away from other around the hinge while remaining joined at the bottom hinge.

The Badlands Zip-No™ magnetic closure system avoids the use of the usual zipper to secure the opening of the clamshell construction. The two edges of the clamshell opening are lined with tubes containing small and thin magnets lined up end-to-end. The magnets are placed in the tubes such that their polarities attract opposing magnets on the other side of the opening. The edges of the clamshell opening meet each other but do not overlap. The front clamshell half has a stiffened loop at its top to pull against to separate the clamshell halves (the rear clamshell half will be secured to the user's backpack shoulder straps or other location). Badlands states on its website (www.badlandsgear.com) that the Zip-No™ magnetic closure system creates a quiet and secure method of closing cases and pouches that is "dustproof, watertight, and keeps gear secure."

Improved carriers with magnetic closure systems, capable of securing lids to overlap the openings in carriers such as belt bags, shoulder bags, and backpacks, are desirable. The magnetic closures systems of such carriers should be strong enough to keep gear securely within the internal compartment even when the carrier is held upside down. The carriers should reliably snap into place when closed and should not be unduly expensive or difficult to make.

BRIEF SUMMARY OF THE INVENTION

Carriers are provided with magnetic closure systems. The carriers comprise a receiver with walls defining an internal compartment for holding articles and having an opening. A lid is provided for closing the opening to the compartment. The lid is hingeably connected to a wall of the receiver. An internal strip of flexible material is provided in the receiver around the opening to the internal compartment. An external strip of flexible material is provided in edges of the lid not occupied by the hingeable connection to the receiver. The internal and external strips contain magnets located and positioned to form attracting pairs when the strips approach each other. When together, the pairs of magnets lock the strips together side-by-side in an overlapping arrangement.

A human user may open the lid by peeling or pulling the lid away from the opening. Pull tabs or loops may be provided on the lid to assist the user to peel or pull the lid away from the opening, or the user can simply grasp an edge or corner of the lid spaced from the hinge and pull up and above the hinge.

Conversely, the user may flips the lid toward the opening in order to close the opening. The user will not have to be precise about this motion because the attracting magnet pairs will pull the outer strip over the inner strip until the magnets of the pairs are adjacent each other and the lid will be secured.

Additional devices such as zippers or hooks and loops may be provided to secure the lid in place over the opening when additional security is desired.

DETAILED DESCRIPTION OF THE INVENTION

Figure 1:
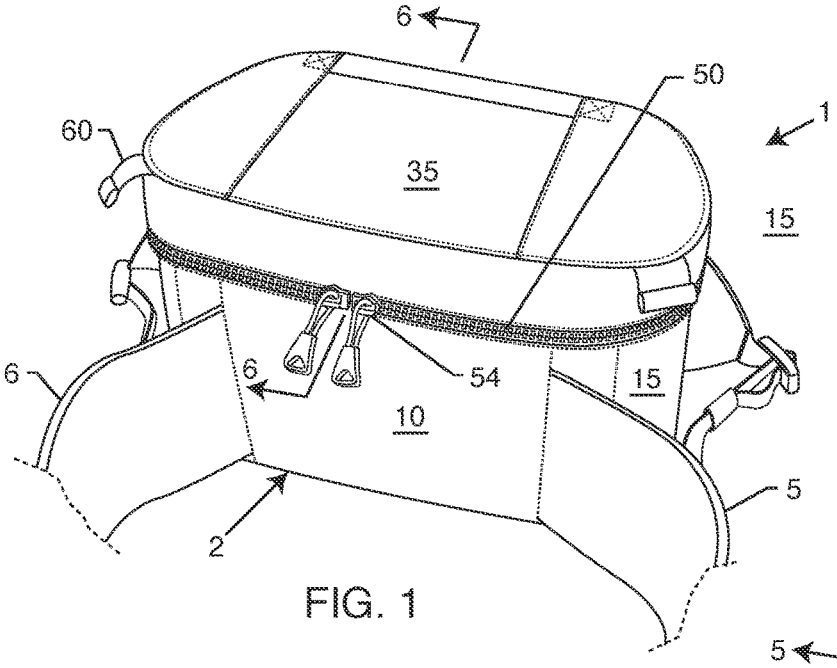
FIG. 1 is a perspective view of the back, top, and left side of an embodiment of a belt bag or waist bag with a magnetic closure system according to this disclosure, with portions of the belt of the belt bag not being shown, in which a top lid of the belt bag is closed.

This detailed specification describes two preferred embodiments of carriers with magnetic closure systems, the first embodiment being a belt bag or waist bag 1 and the second a backpack 100.

FIGS. 1-6 depict the belt bag 1 and FIGS. 8-14 the backpack 100.

Belt Bag

The belt bag 1 comprises a receiver 2 joined to a left side belt 5 and a right side belt 6, as shown in FIGS. 1-4. The left side belt 5 and the right side belt 6 may be joined to each other by a buckle (not shown in the drawings), as is conventional for belt bags.

The receiver 2 has a back wall or body-contacting wall 10 joined to a left side wall 15 and a right side wall 20. The left side wall 15 and the right side wall 20 are each joined to the front wall 25. The back wall 10, the left side wall 15, the right side wall 20, and the front wall 25 are joined to the bottom wall 30 and define an interior compartment 3 with an opening 4 at the top of the internal compartment 3.

"Left" and "right" refer to the positioning of the belt bag 1 with respect to a human user when the receiver 2 of the belt bag 1 is worn on the back of the waist of the user. Thus, the left side wall 15 will be on the left side of the user when the receiver 2 of the belt bag 1 is worn on the back of the waist of the user and the right side wall 20 will be on the right side of the user when the receiver 2 of the belt bag 1 is worn on the back of the waist of the user. "Back" refers to the portion of the belt bag 1 that is next to the user when he or she is wearing the belt bag 1 and is thus proximal to the user. "Front" is opposed to "back" and refers to the portion of the belt bag 1 that is away from (or distal from) the body of the user. "Bottom" and "top" relate to the normal positioning of the belt bag 1 on the waist of the user so that the opening 4 is vertically above the bottom wall 30.

The back wall 10, the left side wall 15, the right side wall 20, the front wall 25, and the bottom wall 30 are preferably made of a flexible material, such as fabric, on the outside and a flexible material, such as fabric, on the inside sandwiching a layer of closed-cell foam that adds stiffening and some padding for the contents of the belt bag 1. These walls may be sewn together. Of course, two or more of the back side wall 10, the left side wall 15, the right side wall 20, and the front wall 25 may be formed from single pieces of fabric inside and outside as well as a single piece of closed-cell foam. The bottom wall 30 may be a separate structure sewn to the back wall 10, the left side wall 15, the right side wall 20, and the front wall 25.

Figure 2:
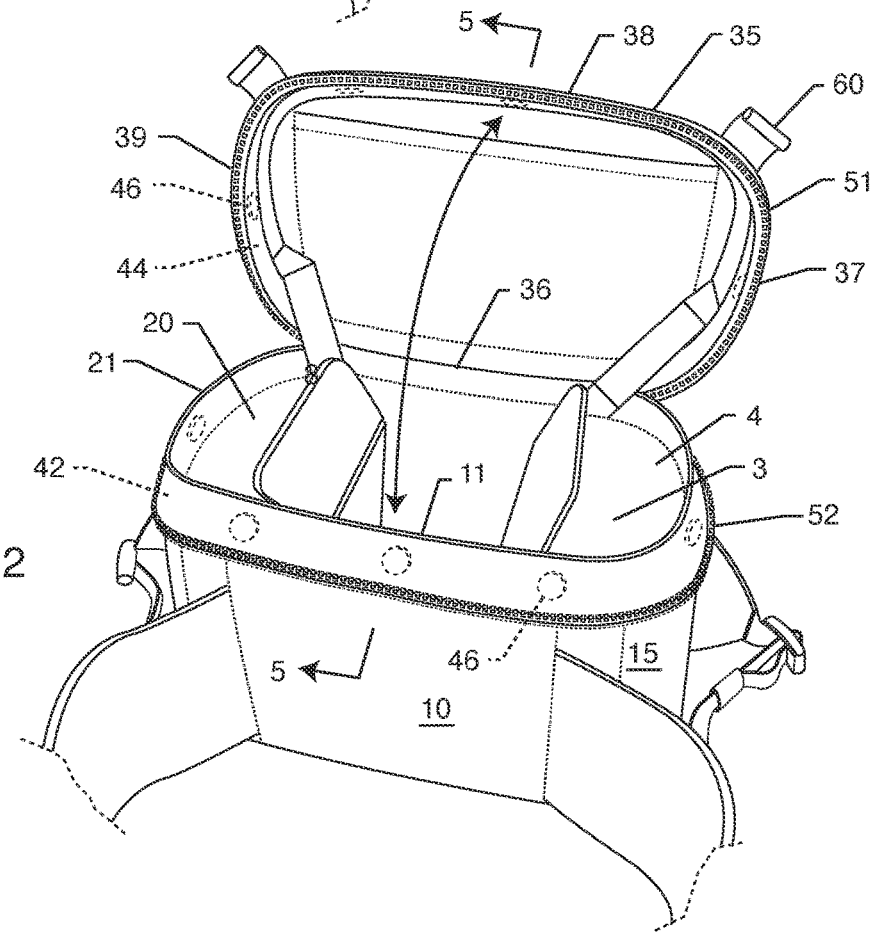
FIG. 2 is a perspective view of the embodiment of the belt bag of FIG. 1 in which the top lid of the belt bag is open to allow access to an internal compartment defined in the belt bag.
Figure 3:
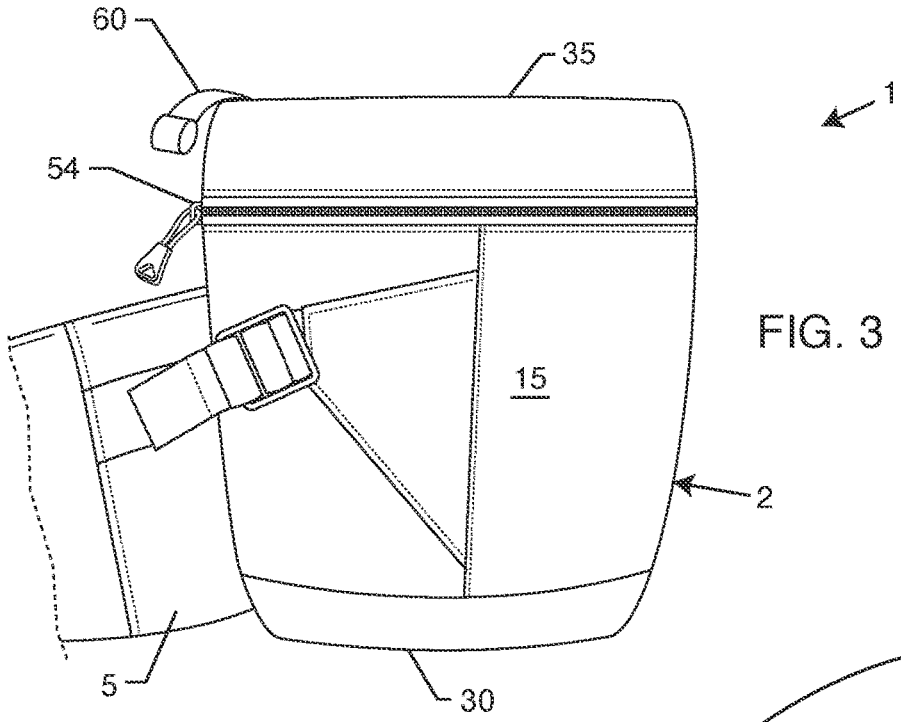
FIG. 3 is a view of the left side of the embodiment of the belt bag of FIG. 1 in which the lid of the belt bag is closed.
Figure 4:
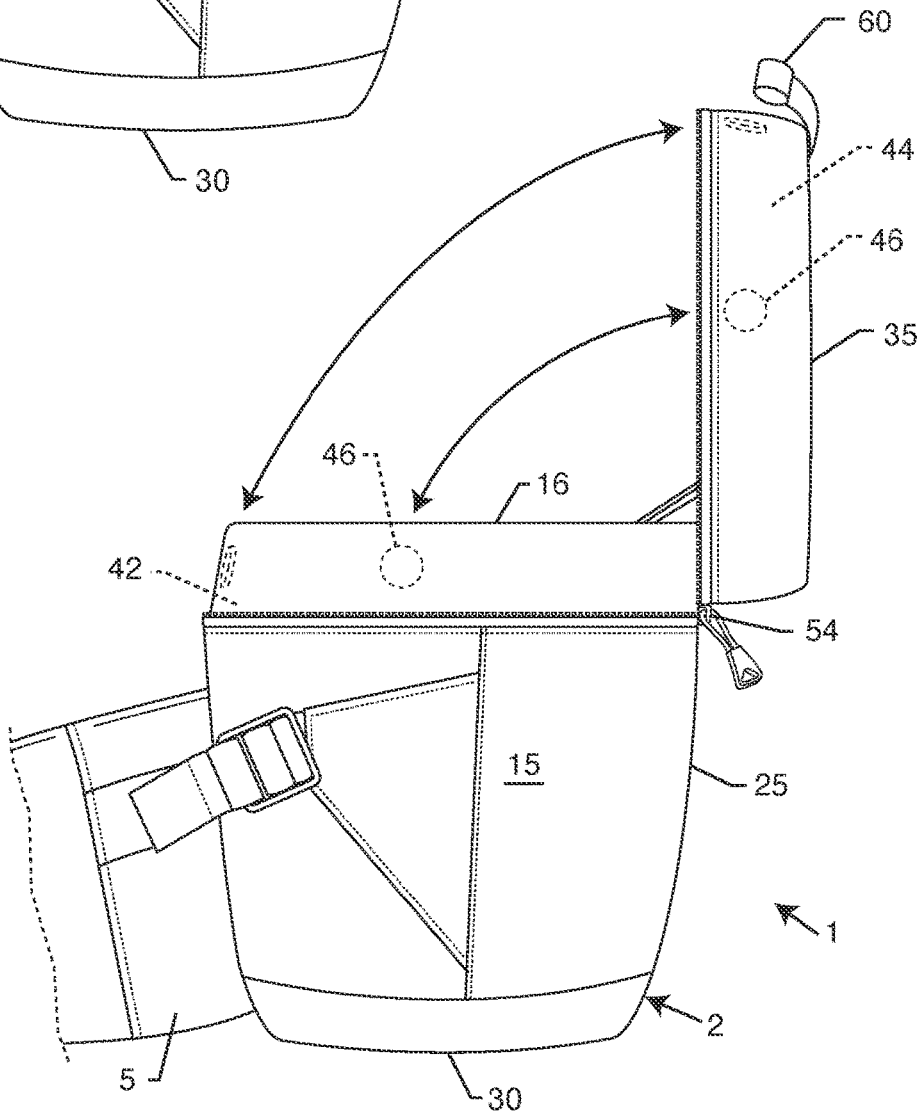
FIG. 4 is a view of the left side of the embodiment of the belt bag of FIG. 1 in which the top lid of the belt bag is open.
Figure 5:
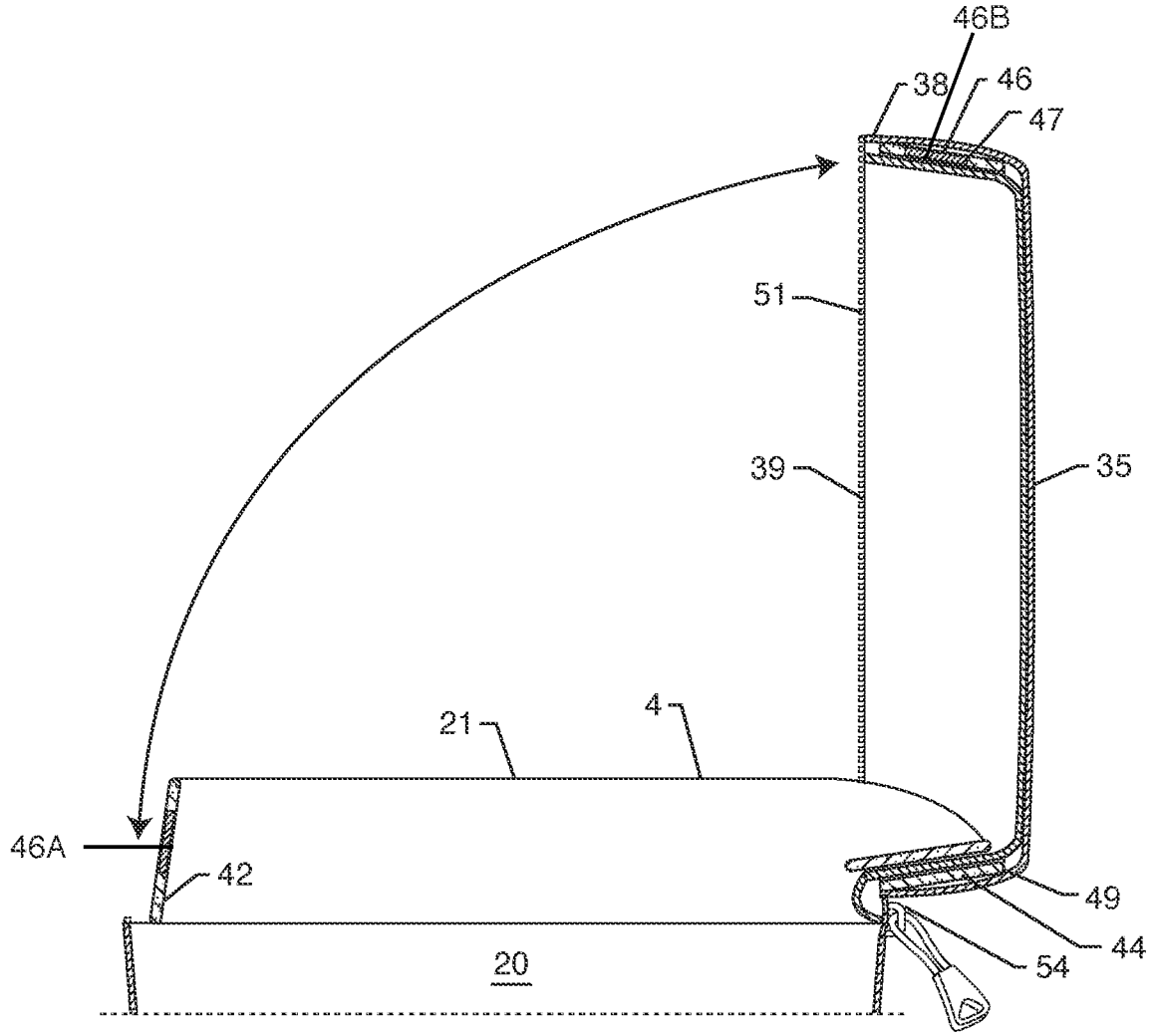
FIG. 5 is a sectional view along the plane 5-5 indicated in FIG. 2 of the top of the embodiment of the belt bag of FIG. 1, in which the top lid of the belt bag is open.

The receiver 2 of the belt bag 1 has a cover or lid 35 that is attached to the front wall 25 by a hinge 36. The hinge 36 could be a piece of flexible material sewn or otherwise attached to each of the lid 35 and the front wall 25. Alternatively it could be the continuation of the outer fabric of the front wall 25 to the lid 35 (or vice-versa). The lid 35 is removeably attached to the back wall 10, the left side wall 15, and the right side wall 20, as will be described in more detail below. The lid 35 covers the opening 4 when the lid 35 is attached to the back wall 10, the left side wall 15, and the right side wall 20 and thereby closes the internal compartment 3 as shown in FIGS. 2, 4, and 5. Closing the internal compartment 3 prevents articles carried in the internal compartment 3 from falling out and protects the internal compartment 3 from the entry of water, dust, or sand.

Detaching the lid 35 from the back wall 10, the left side wall 15, and the right side wall 20 permits the lid 35 to rotate about the hinge 36 and away from the opening 4, as shown in FIGS. 2, 4, and 5. The lid 30 will also rotate about the hinge 36 away from the user when the belt bag 1 is worn on the waist of the user. Preferably, the user will shift the belt bag 1 around his or her waist in order to place the receiver 2 in front of the user so the user can rotate the lid 35 and look into the compartment 3. The lid 35 will thereby not be in the way of the user when accessing articles in the internal compartment 3.

A magnetic closure system 40 in the receiver releasably secures the lid 35 to the back wall 10, the left side wall 15, and the right side wall 20. The magnetic closure system 40 comprises an inner strip 42 and an outer strip 44. The inner strip 42 is associated with a first plurality 46A of spaced magnets 46 and the outer strip 44 is associated with a second plurality 46B of spaced magnets 46.

Figure 6:
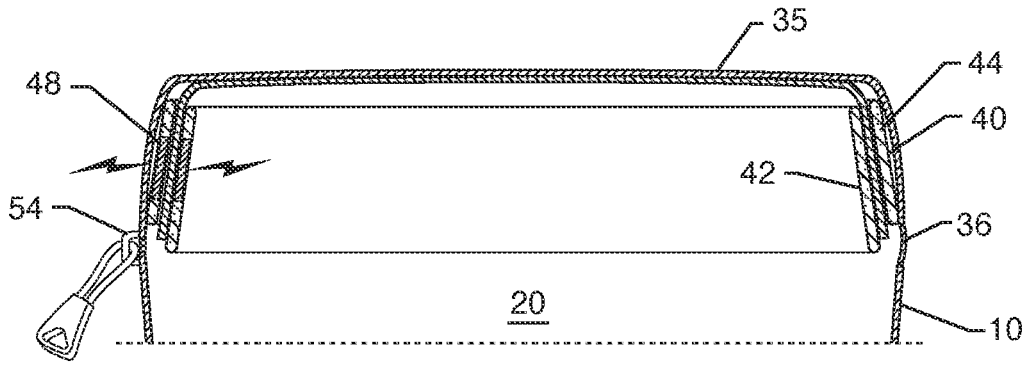
FIG. 6 is a sectional view along the plan 6-6 indicated in FIG. 1 of the top of the embodiment of the belt bag of FIG. 1 in which the top lid of the belt bag is closed.

The strips 42 and 44 are generally rectangular and belt-like, preferably having a length sufficient to wrap around the edge of the opening 4 except for the part of the opening 4 adjacent to the hinge 36. The strips 42 and 44 in the belt bag 1 shown in FIGS. 1-6 preferably are long enough to wrap around the entire opening 4, including the part of the opening 4 adjacent to the hinge 36. As indicated in FIGS. 5 and 6, the strips 42 and 44 continue around or above the edge of the opening 4 in the region of the hinge 36.

The strips 42 and 44 will each have a width that is much less than that of their lengths. Their width is sufficient to accommodate the transverse holes 47 in which the magnets 46 will be placed. The thickness of the strips 42 and 44 preferably will be less than their widths in order to keep the strips 42 and 44 flexible but sufficiently thick to accommodate the thickness of the magnets 46.

The strips 42 and 44 may have different widths, but preferably their widths are in the range of 0.875 inch to 1.25 inches. The outer strip 44 is intended to overlap the inner strip 42 when the opening 4 is closed. By "overlap," this specification means that a side of the outer strip 44 is in contact with a side of the inner strip 42 along a length of the inner strip 42 and preferably along the entire length of the inner strip 42. The purpose of having the outer strip 44 overlap the inner strip 42 is to permit the magnets 46 of the magnet pairs 48 in the strips 42 and 44 to come into close proximity. The mutual attraction of the magnets 46 of each pair 48 will maintain the strips 42 and 44 in an overlapped configuration and thus keep the lid 35 closed over the opening 4.

The strips 42 and 44 preferably are cut from a sheet made of a flexible material that tends to retain its shape. An example of such a material is high density closed cell foam. Three millimeter thick density closed cell foam is currently preferred when N52 magnets are employed, as discussed below.

The inner strip 42 is embedded inside and just below the top edges 11, 16, and 21 of the back wall 10, the left side wall 15, and the right side wall 20, respectively. The outer strip 44 is embedded inside and runs along the corresponding edges 37, 38, and 38 of the lid 35. The inner strip 42 and the outer strip 44 in the vicinity of the hinge 3642 adjoin and overlap each other, as shown in FIG. 6, and remain adjoined and overlapped even when the remainder of the lid 35 moves to cover or uncover the top opening 4. The ends of each of the strips 42 and 44 preferably meet above the hinge 36.

The strip 42 is contained in and hidden from view by a sleeve 43 made of the fabric of the walls 10, 15, 20, and 25 and the strip 44 is contained in and hidden from view by a sleeve 45 made of the fabric of the lid 35. Alternatively, the sleeves 43 and 45 could be made of separate pieces of fabric sewn onto the walls 10, 15, 20, and 25 and the strip 44, respectively. In order to simplify the drawings, the fabric sleeves 43 and 45 covering the strips 42 and 44 are not shown in all the drawings, such as in FIGS. 5 and 6.

The magnets 46 are placed in holes 47 in the strips 42 and 44 that preferably are the size and shape of the magnets 46. The magnets 46 shown in the drawings are cylindrical with their magnetic poles located on their circular flat ends. The holes 47 will then be cylindrical and sized to snugly accommodate the magnets 46. The holes 47 in the strips 42 and 44 are sited so that a magnet 46 in the inner strip 42 will be adjacent to a magnet 46 in the outer strip 44 when the lid 35 is located against over the opening 4 of the inner compartment 3 of the receiver 2. As shown in FIGS. 2 and 4, the inner strip 42 has five magnets 46 and the outer strip 44 has five magnets. The magnetic closure system 40 of the embodiment of the belt bag 1 shown in FIGS. 1-6 therefore has five pairs 48 of the magnets 46. More or fewer pairs 48 of the magnets 46 may be provided depending on the size of the belt bag 1 and the disclosure therefore is not limited to or require five pairs 48 of magnets 46 for a belt bag.

The magnets 46 preferably are strong disk-shaped magnets. N52 3 mm×13 mm neodymium magnets currently are preferred. Each of the magnets 46 in the strips 42 and 44 is placed in its hole 47 with the appropriate polarity to attract the corresponding magnet 46 in the other of the strips 42 and 44. Thus, a magnet 46 placed in its hole 47 in the inner strip 42 so that its south pole faced toward the corresponding magnet 46 in the outer strip 44 would require that the north pole of the corresponding magnet 46 in the outer strip 44 face toward the corresponding magnet 46 in the inner strip 42 so the magnets 46 of that pair 48 attract rather than repel each other.

The holes 47 in the strips 42 and 44 preferably are sized and shaped to prevent movement of the magnets 46 along the length of the strips 42 and 44. The simplest method is to drill the holes 47 completely through the strips 42 and 44 and choose the thickness of the strips 42 and 44 to correspond to the thickness of the magnets 46 (three millimeters in this embodiment). The magnets 46 should not be allowed to move with respect to the strips 42 and 44 in which they are embedded. Each of the strips 42 and 44 preferably should be wrapped with a layer (or cladding) 49 of material that will prevent the magnets from coming out of the holes 47 perpendicularly to the strips 42 or 44. The layer 49 could be a plastic film shrink-wrapped around each of the strips 42 and 44 or an adhesive tape adhered around each of the strips 42 and 44.

The inner strip 42 preferably is formed so that it tilts inwardly from bottom to top like a pyramidal-conical frustrum as shown in FIGS. 2 and 4. The outer strip 44 preferably is similarly formed but the outer strip 44 is larger so that the outer strip 44 will overlap and mate side-to-side with the inner strip 42 as shown in FIG. 6. The purpose of this configuration of the strips 42 and 44 is to provide for a smooth joining of the strips 42 and 44 when the user decides to close the opening 4 of the receiver 2. The strips 42 and 44 provide sufficient rigidity to maintain the shape of the opening 4 and the shape of the lid 35 such that the magnet pairs 48 will swiftly and easily form to secure the lid 35 in place.

The preferred angle of tilt or inclination of the inner strip 42 and the outer strip 44 is chosen to avoid having the outer strip 44 snag or catch on the inner strip 42 when closing the opening 4 of the receiver 2. An angle of 90 degrees from the horizontal risks catching whereas an angle of zero degrees from the horizontal ("horizontal" referring to the plane of the opening 4) would not have that problem but would require too much horizontal space in the receiver 2. An angle in the range 50 degrees to 80 degrees is preferred.

In addition to the magnetic closure system, in this embodiment a zipper 50 is provided to secure the lid 35 to the back wall 10, the left side wall 15, and the right side wall 20. The zipper 50 has a zipper half 51 attached to the back wall 10, the left side wall 15, and the right side wall 20 generally below the bottom of the inner strip 42 and a corresponding and mating zipper half 52 attached to the edges 37-39 of the lid 35. The zipper pulls 54 open and shut the zipper 50 and physically secure the lid 35 to the back wall 10, the left side wall 15, and the right side wall 20.

The user thus has two options for securing the lid 35 to the back wall 10, the left side wall 15, and the right side wall 20: 1) relying on the magnetic closure system 40 and leaving the zipper 50 open, and 2) adding the security of the zipper 50 to the effect of the magnetic closure system 40.

The first choice permits the user to pull the lid 35 away from the opening 4 by grasping one of the pull tabs 60 attached to corners of the lid 35 and pulling up and away from the rest of the receiver 2, thus separating the magnet pairs 48. The rotation of the lid 35 is most easily done when the receiver 2 is worn on the front of the user. The opening of the magnetic closure system 40 is quicker than the action of unzipping the zipper 50 and is also more quiet. These are advantages for a user who is a photographer and needs quick and quiet access to a camera or camera gear contained in the inner compartment 3 of the receiver 2.

The lid 35 is easily and quickly secured over the opening 4 by simply flipping the lid 35 around the hinge 36 and back toward the back wall 10, the left side wall 15, and the right side wall 20. The outer strip 44 will pass over and envelope the inner strip 42, assisted by the mutual attraction of the magnets 46 of each magnet pair 48. The lid 35 simply snaps into place.

Experience has shown that the magnetic closure system 40 is strong enough to maintain the position of the lid 35 over the opening 4 in everyday use. The inventor placed twenty pounds of iron weights (dumbbells) in the internal compartment of a prototype of the belt bag 1 and then closed the lid over the opening to the internal compartment. He did not use the zipper to secure the lid. He turned the prototype belt bag upside down and shook it. The lid remained in place and kept the iron weights from falling out.

Nevertheless, the user may wish for additional security in case of violent movement, accidents such as dropping the belt bag 1 and passing through extremely unfavorable environments such as sandstorms or the like. Closing the zipper 50 provides that additional security.

Backpack

The second embodiment of a carrier with a magnetic closure system is the backpack 100 that is shown in FIGS. 7-14. The backpack 100 comprises a receiver 102 comprising a front wall 104, a back or body-contacting wall 106, a left side wall 108 connected to the front wall 104 and the back wall 106, a right side wall 110 connected to the front wall 104 and the back wall 106, a bottom wall 112 connected to the front wall 104, the back wall 106, the left side wall 108, and the right side wall 110. Together, the front side wall 104, the back wall 106, the left side wall 108, the right side wall 110, and the bottom wall 112 define an internal compartment 114 with an opening 116 at the top of the receiver 102.

The backpack 100 has a left shoulder strap 103L and a right shoulder strap 103R attached to the receiver 102. The upper ends of the left shoulder strap 103L and the right shoulder strap 103R may be attached to the back wall 106 and the lower ends to the back wall 106 or at the intersections of the back wall 106 and the left and right side walls 108 and 110, respectively. Although not shown in the drawings, a waist belt may be attached to the lower part of the back wall 106.

"Left" and "right" refer to the positioning of the receiver 102 of the backpack 100 with respect to the user when the receiver 102 of the backpack 100 is worn on the back of the user. Thus, the left side wall 108 and the left shoulder strap 103L will be on the left side of the user when the receiver 102 of the receiver 102 is worn on the back of the user and the right side wall 110 and the right shoulder strap 103R will be on the right side of the user when the receiver 102 of the backpack 100 is worn on the back of the user. "Back" refers to the portion of the receiver 102 that is next to the user when he or she is wearing the backpack 100 and is thus proximal to the user. "Front" is opposed to "back" and refers to the portion of the receiver 102 that is away from (or distal from) the body of the user. "Bottom" and "top" relate to the normal positioning of the receiver 102 on the back of the user so that the opening 116 is vertically above the bottom wall 112.

The front wall 104, the back wall 106, the left side wall 108, the right side wall 110, and the bottom wall 112 are preferably made of a flexible material, such as fabric. These walls may be sewn together or formed from single pieces of fabric. Of course, two or more of the front wall 104, the back wall 106, the left side wall 108, the right side wall 110, and the bottom wall 112 the may be formed from single pieces of fabric. As with the belt bag 1, the walls may be made of two layers of fabric sandwiching a layer of closed cell foam or other material that provides shape to the backpack 100 and protection for the contents of the internal compartment 114.

Figure 7:
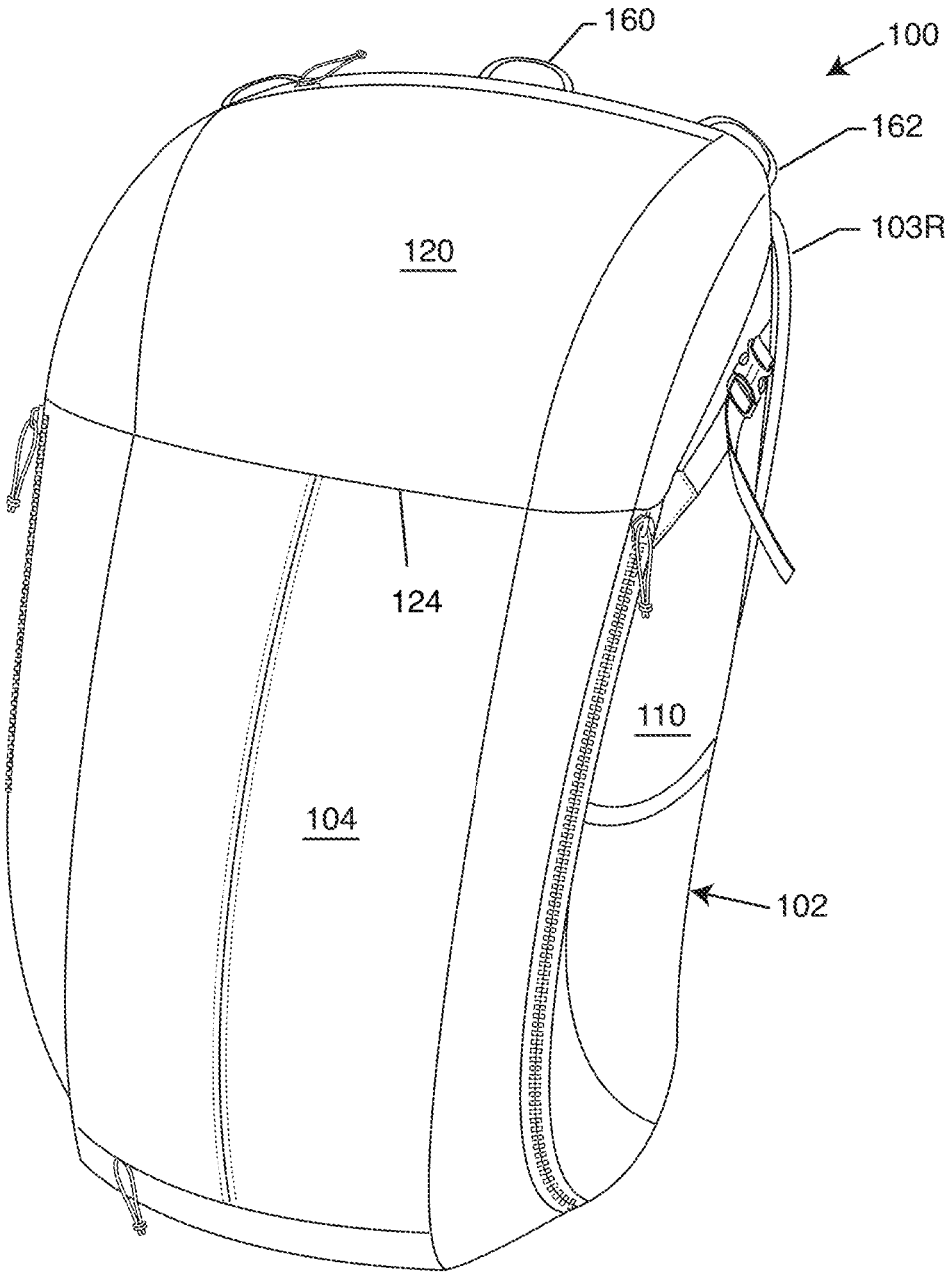
FIG. 7 is a perspective view of the top, the front side, and the right side of a backpack with a magnetic closure system according to this disclosure, in which the top lid of the backpack is closed.
Figure 10:
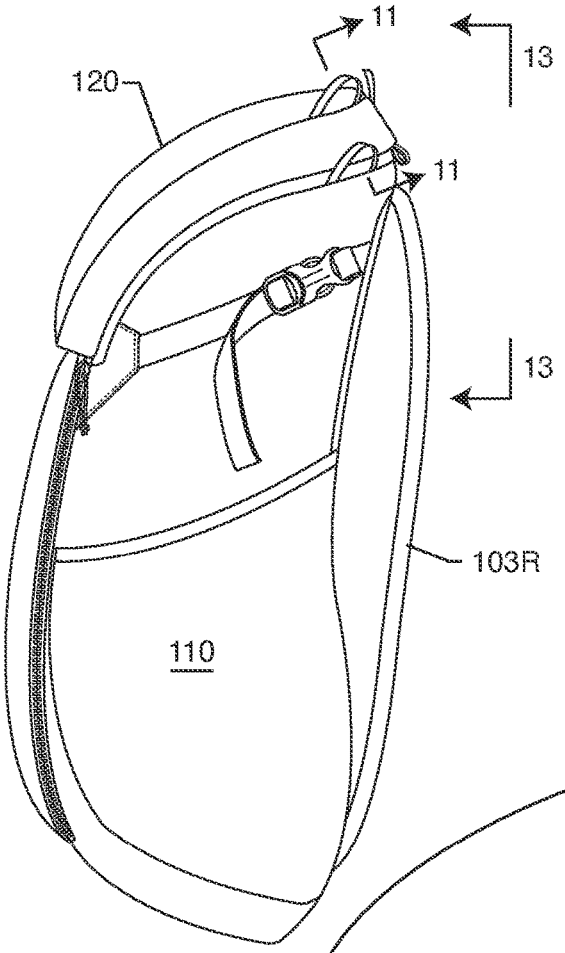
FIG. 10 is a view of the right side of the embodiment of the backpack of FIG. 7 in which the top lid of the backpack is closed.
Figure 11:
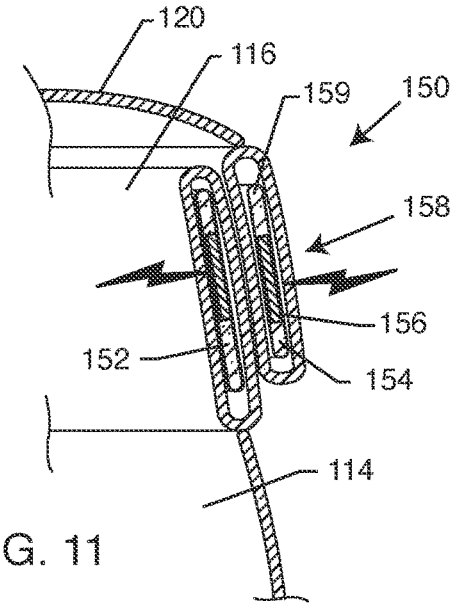
FIG. 11 is a sectional view of a portion of the embodiment of the backpack of FIG. 7 taken along the plane 11-11 in FIG. 10.

The receiver 102 of the backpack 100 has a cover or lid 120 that is attached to the front wall 104 by a hinge 118. The lid 120 is removeably attached to the back wall 106, the left side wall 108, and the right side wall 110, as will be described in more detail below. The lid 120 covers the opening 116 when the lid 120 is attached to the back wall 106, the left side wall 108, and the right side wall 110 and thereby closes the internal compartment 114 as shown in FIGS. 7, 10, and 11. Closing the internal compartment 114 prevents articles carried in the internal compartment 114 from falling out and also protects the internal compartment 114 from the entry of water or dust.

Figure 8:
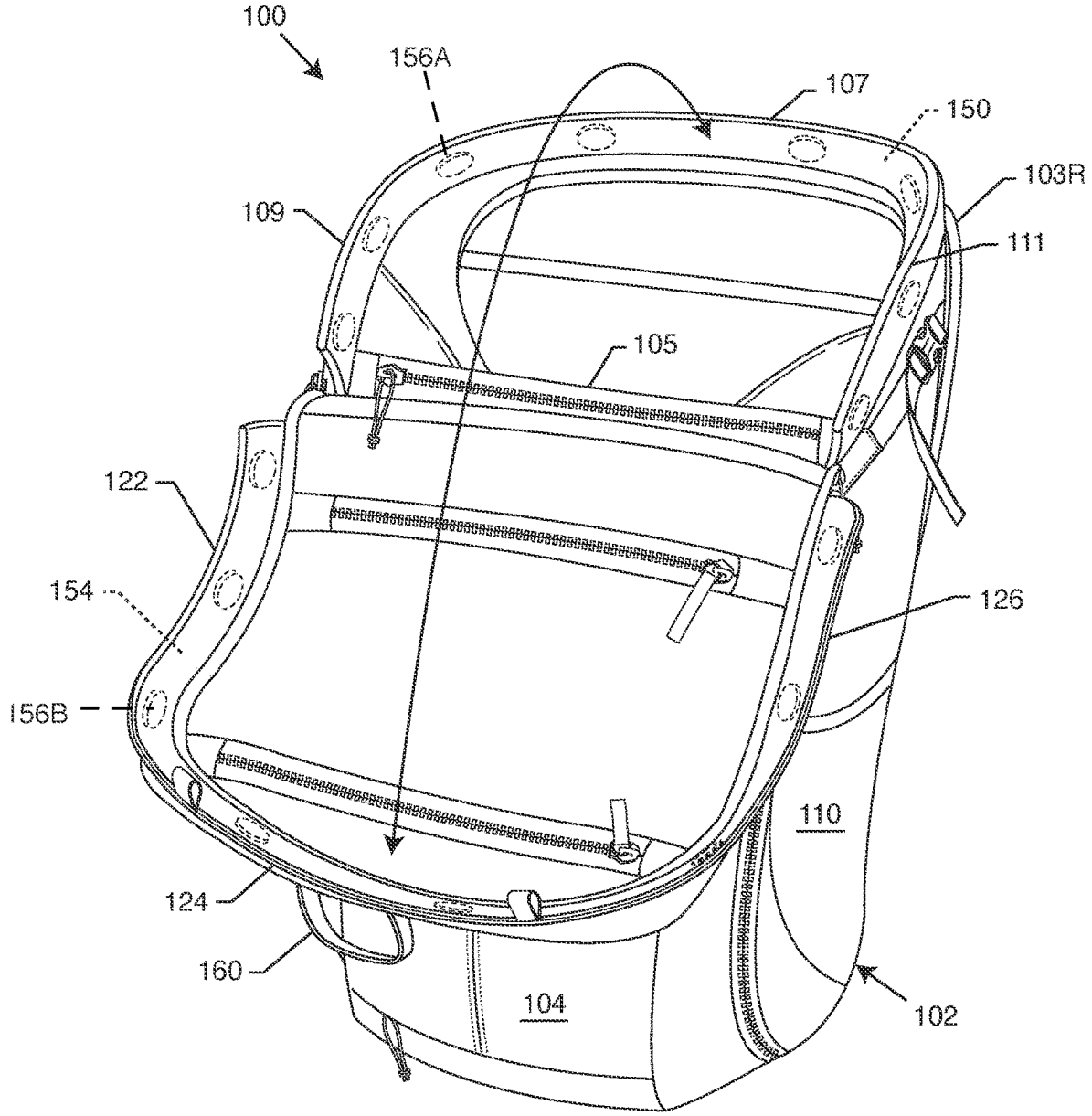
FIG. 8 is a perspective view of the top, the front side, and the right side of the embodiment of the backpack of FIG. 7, in which the top lid of the backpack is open.
Figure 9A:
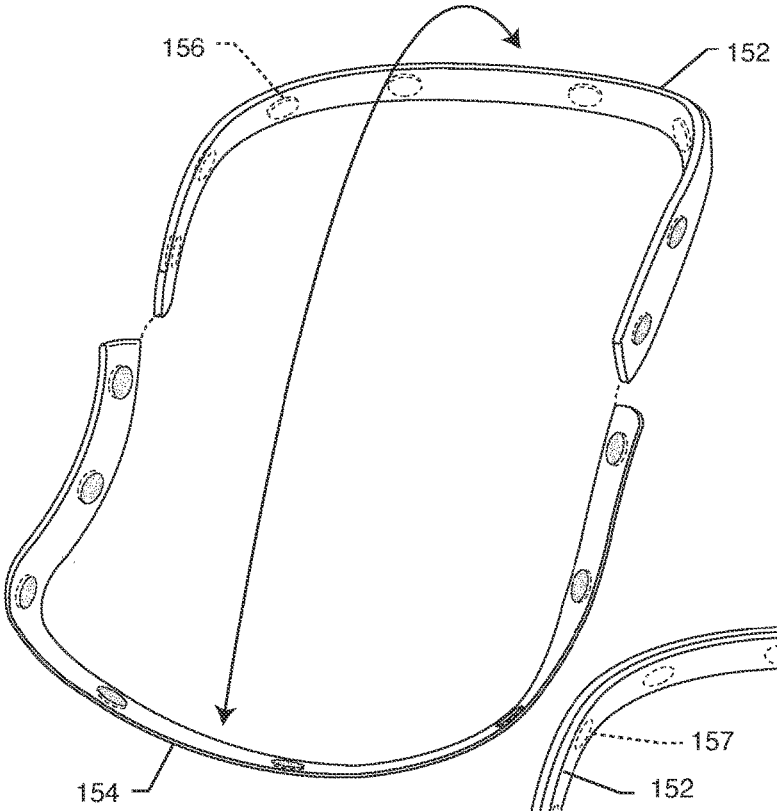
FIG. 9A is a perspective view of the internal and external strips of the magnetic closure system employed in the embodiment of the backpack of FIG. 7, as they would be positioned in FIG. 8.
Figure 9B:
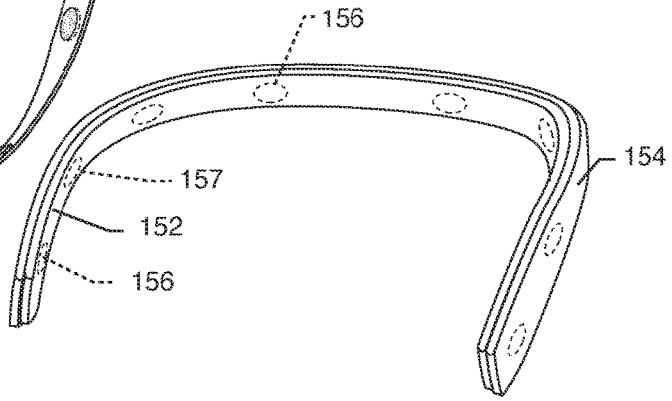
FIG. 9B is a perspective view of the internal and external strips of the magnetic closure system employed in the embodiment of the backpack of FIG. 7, as they would be positioned in FIG. 7.
Figure 9C:
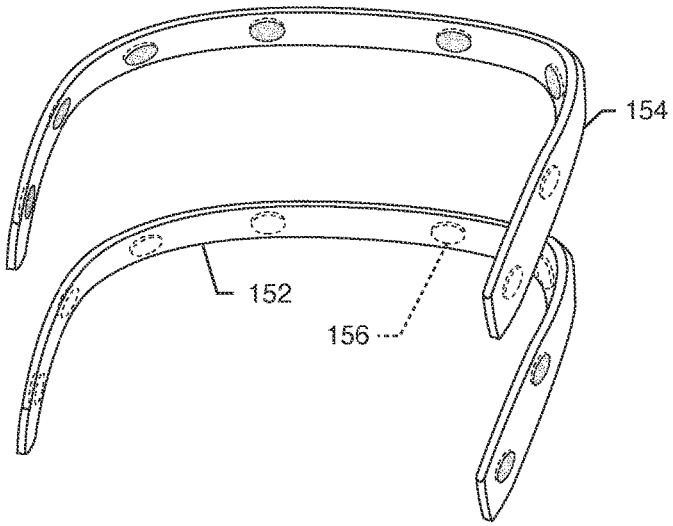
FIG. 9C is a perspective view of the internal and external strips of the magnetic closure system employed in the embodiment of the backpack of FIG. 7, in which the strips are shown approaching each other in order for the external strip to overlap the internal strip.
Figure 12:
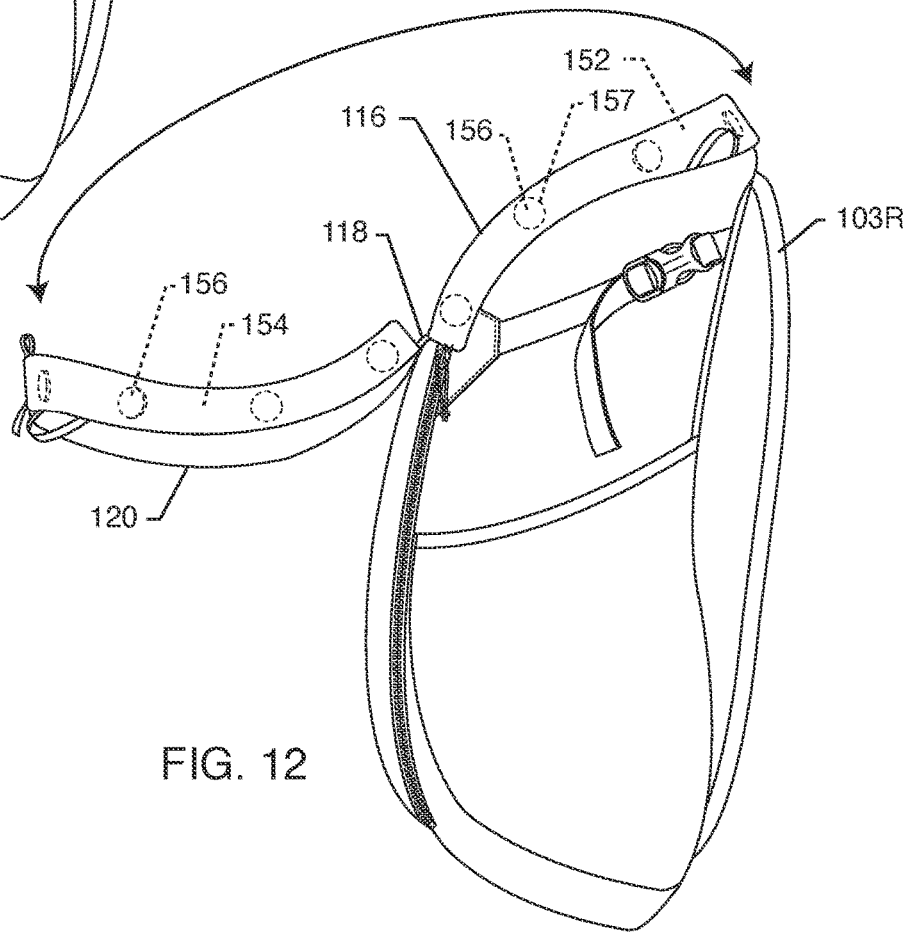
FIG. 12 is a view of the right side of the embodiment of the backpack of FIG. 7 in which the top lid of the backpack is open.
Figure 13:
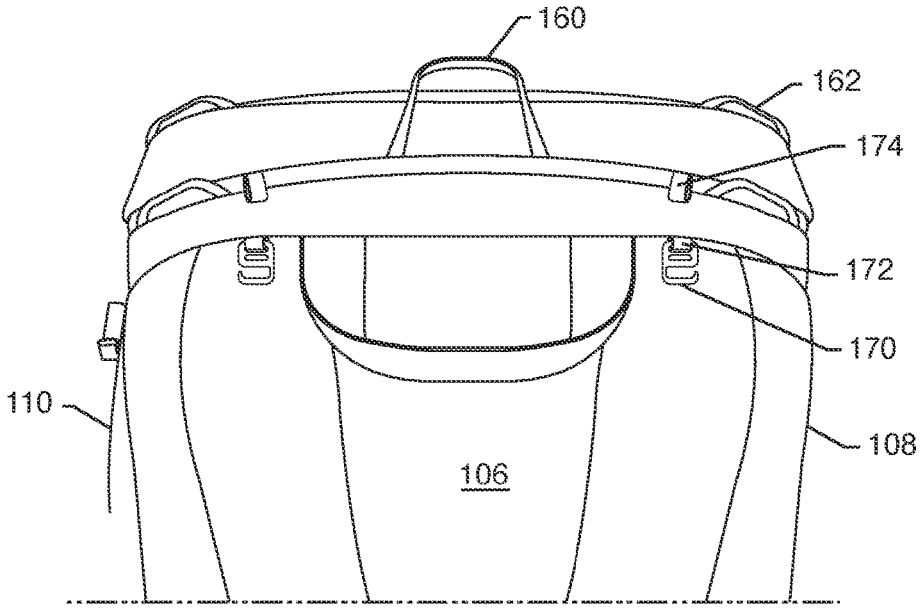
FIG. 13 is a view of the back or body-contacting side and top lid of the embodiment of the backpack of FIG. 7, as indicated by the view arrows in FIG. 10, in which the top lid of the backpack is closed.
Figure 14:
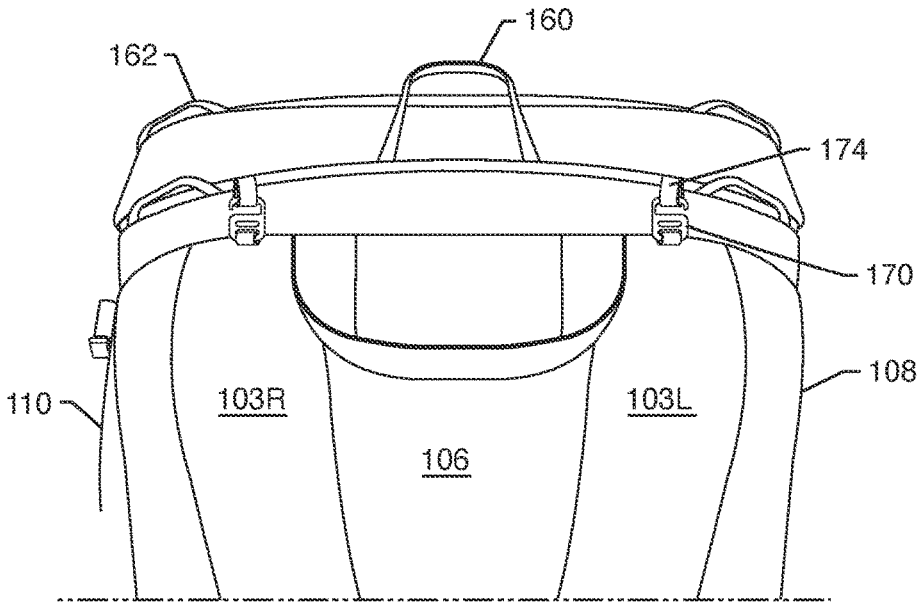
FIG. 14 is a view of the back or body-contacting side and top lid of the embodiment of the backpack of FIG. 7 in which the top lid of the backpack is closed and further secured by hooks on the receiver being attached to loops on the top lid.

Detaching the lid 120 from the back wall 106, the left side wall 108, and the right side wall 110 permits the lid 120 to rotate about the hinge 118 and away from the opening 116, as shown in FIGS. 8 and 12. The lid 120 will also rotate about the hinge 118 away from the user when the user brings the receiver 102 to his or her front by taking his or her shoulders out of the shoulder straps 103L and 103R and rotates the receiver 102 around to his or her front. (The user loosens the waist belt, if one is provided, and pulls the receiver 102 around so that the waist belt sliding around the waist of the user.) The user then can rotate the lid 120 and look into the internal compartment 114. The lid 120 will not be in the way of the user when accessing articles in the internal compartment 114.

A magnetic closure system 150 in the receiver releasably secures the lid 120 to the back wall 106, the left side wall 108, and the right side wall 110. The magnetic closure system 150 comprises an inner strip 152 and an outer strip 154. The inner strip 152 is associated with a first plurality 156A of the spaced magnets 156 and the outer strip 154 is associated with a second plurality 156B of the spaced magnets 156.

The inner strip 152 is embedded in and extends under the top edges 107, 109, and 111 of the back wall 106, the left side wall 108, and the right side wall 110, respectively. The fabric of the top edges 107, 109, and 111 of the back wall 106, the left side wall 108, and the right side wall 110 form a sleeve 153 that contains the strip 152. Preferably, the sleeve 153 is sewn through under the strip 152 in order to secure the sleeve 152 in place.

The outer strip 154 is embedded in and runs along the corresponding edges 122, 124, and 126 of the lid 120. The fabric adjacent the edges 122, 124, and 126 form a sleeve 155 that contains the strip 155. Preferably, the sleeve 155 is sewn on the other side of the strip 155 from the edges 122, 124, and 126 of the lid 120 in order to secure the sleeve 155 in place.

The strips 152 and 154 preferably are made of a flexible yet resilient material that tends to retain its shape. An example of such a material is high density closed cell foam. Three millimeter high density closed cell foam is currently preferred. The magnets 156 are placed in holes 157 in the strips that are the size and shape of the magnets 156.

The holes 157 in the strips 152 and 154 are sited so that a magnet 156 of the first plurality 156A of magnets associated with the inner strip 152 will be adjacent to a magnet 156 of the second plurality 156B associated with the outer strip 154 when the lid 120 is located against over the opening 116 of the inner compartment 114 of the receiver 102. As shown in FIGS. 9 and 12, the first plurality 156A of magnets 156 associated with the inner strip 152 has eight magnets 156 and the second plurality 156B of magnets 156 associated with the outer strip 154 has eight magnets 156. The magnetic closure system 150 of the embodiment of the backpack 100 shown in FIGS. 9-14 therefore has eight pairs 158 of the magnets 156. More or fewer such pairs 158 might be provided depending on the size of the backpack 100 and this disclosure is not to be considered as limiting the number of pairs to eight for a backpack 100 or excluding a lower number of pairs 158 for a backpack 100.

The magnets 156 preferably are N52 3 mm×13 mm neodymium disk-shaped magnets with their poles located in their flat circular-shaped ends. Each of the magnets 156 in the strips 152 and 154 is placed in its hole 157 with the appropriate polarity to attract the corresponding magnet 156 in the other of the strips 152 and 154. Thus, a magnet 156 placed in its hole 157 in the inner strip 152 so that its south pole faced toward the corresponding magnet 156 in the outer strip 154 would require that the north pole of the corresponding magnet 156 face toward the magnet 156 in the inner strip 152 so the magnets 156 of that pair 158 attract each other rather than repel each other.

The holes 157 in the strips 152 and 154 preferably are sized and shaped to prevent movement of the magnets 156 along the strips 152 and 154. The simplest method is to drill the holes 157 completely through the strips 152 and 154 and choose the thickness of the strips 152 and 154 to correspond to the thickness of the magnets 156. The strips 152 and 154 preferably should be wrapped with a layer or cladding 159 of material that will prevent the magnets from coming out of the holes 157. The layer 159 could be a plastic film shrink-wrapped around each of the strips 152 and 154 or an adhesive tape adhered around each of the strips 152 and 154.

As with the inner strip 42 and outer strip 44 of the belt bag 1, the inner strip 152 preferably is formed so that it tilts inwardly from bottom to top like a pyramidal-conical frustrum as shown in FIGS. 8, 9A, 9B, 9C, and 10-12. The outer strip 154 preferably is similarly formed but is larger so that the outer strip 154 can overlap the inner strip 152 as shown in FIG. 11. The purpose of this configuration of the strips 152 and 154 is to provide for a smooth joining of the strips 152 and 154 when the user decides to close the opening 116 of the receiver 102. The discussion of the angle of the strips 42 and 44 in the belt bag 1 embodiment is also applicable to magnetic closure system 150 of the backpack 100.

The inner strip 152 and the outer strip 154, as shown for example in FIG. 8, do not extend completely around the opening 116. This is unlike the magnetic closing system 40 of the belt bag 1, in which the inner strip 42 and the outer strip 44 ringed or circumscribed the top opening 4. The receiver 102 is provided with an inner front wall 106 under the hinge 118. The inner front wall 106 is stiffened, such as by incorporating closed cell foam, in order to resist lateral compression of the receiver 102 in the vicinity of the hinge 118 and thereby maintain the shape of the opening 116 to facilitate the closing of the lid 120 over the opening 116. Together, the inner strip 152, the outer strip 154, and the inner front wall 105 provide sufficient rigidity to maintain the shape of the opening 116 and the shape of the lid 120 such that the magnet pairs 158 will swiftly and easily form to secure the lid 120 in place.

The magnetic closure system 40 of the belt bag 1 also could be employed to maintain the shape of the opening 116 and the shape of the lid 120 in a backpack by lengthening the inner strip 152 and the outer strip 154 to both extend and meet under the hinge 118.

The user may pull the lid 120 away from the opening 116 by grasping one of the pull tabs 160 attached to corners of the lid 120 and pulling up and away from the rest of the receiver 102, thus separating the magnet pairs 58. The rotation of the lid 120 is most easily done when the receiver 102 is worn on the front of the user.

The lid 120 is easily and quickly secured over the opening 116 by simply flipping the lid 120 around the hinge 118 and back toward the back wall 106, the left side wall 108, and the right side wall 110. The outer strip 154 will pass over and envelope the inner strip 152, assisted by the mutual attraction of the magnets 156 of each magnet pair 158. The lid 120 simply snaps into place.

Experience has shown that the magnetic closure system 150 is capable of maintaining the position of the lid 120 over the opening 116 in everyday use and keep articles in the inner compartment 114. In fact, the inventor loaded a prototype of the backpack 100 similar to the one described in this specification with twenty pounds of photographic gear. He turned the prototype upside down and shook it. The lid of the prototype did not open and thus retained the gear in its compartment.

Nevertheless, the user may wish for additional security. This security may be provided by attaching an overlapping flap to the lid 120 with a zippered attachment to the receiver 102, as shown in connection with the waist bag 1 of this disclosure. Alternatively, as actually shown in FIGS. 13 and 14 of the drawings, two hooks 170 are attached to the back wall 104 by means of webbing loops 172 sewn into the back wall 104. The hooks 170 are attached to either side of the back wall 104 and positioned just below the lid 120 when the lid 120 is secured over the opening 116. (An alternative configuration provides only one hook 170 at the middle of the lid 120.)

Webbing loops 174 are sewn to the edge 124 of the lid 120 in spaced positions that permit the hooks 170 to be inserted into the webbing loops 174. The lid 120 will be physically locked in place over the opening 116 when the hooks 170 are placed in the webbing loops 174. Preferably the lengths of the webbing loops 162 and 164 are selected so that the hooks 160 will be under some tension when inserted into the webbing loops 174 so that the hooks 170 will not accidentally disengage from the webbing loops 174. This system for securing a lid with a magnetic closure system using webbing loops and hooks could be used with the waist bag 1 of this disclosure in place of the overlapping flap and zipper system discussed above in connection with the waist bag 1 embodiment.

In practice, the user should not engage the hooks 170 with the webbing loops 174 when the user wants to have the benefit of the quick closing and opening of the lid 120.

The invention is intended to cover alternatives, modifications, and equivalents that may be included within the spirit and scope of the invention as defined by the appended claims. For example, other types of carriers may be provided with magnetic closure systems according to the disclosure. Examples of such other types of carriers include wheeled roller bags, pouches, and shoulder bags. The carriers may be made out of fabric or other materials such as plastic.

What is claimed is:

1. A carrier with a magnetic closure system, comprising:

a receiver having walls defining an internal compartment with an opening, a lid sized and shaped to cover the opening, a hinge attaching the lid to one of the walls whereby the lid may rotate about the hinge toward the receiver to cover the opening and rotate about the hinge away from the receiver to uncover the opening, the lid defining an edge other than at the hinge whereby the edge is free to move toward and away from the walls of the receiver, an inner strip having a length attached to the walls adjacent to the opening, an outer strip having a length attached adjacent to a portion of the edge of the lid, wherein the outer strip is adapted to overlap the inner strip when the lid is rotated toward the receiver to cover the opening, wherein the inner strip has a pyramidal-conical frustrum shape and the outer strip has a corresponding pyramidal-conical frustrum shape wherein the outer strip may overlap the inner strip, and wherein the inner strip is associated with a first plurality of magnets located in spaced relationship along at least a portion of the length of the inner strip and the outer strip is associated with a second plurality of magnets located in spaced relationship along at least a portion of the length of the outer strip, the first plurality of magnets associated with the inner strip being positioned to be aligned with the second plurality of magnets associated with the outer strip when the outer strip overlaps the inner strip, and the first plurality of magnets associated with the inner strip having a polarities chosen to attract the corresponding second plurality of magnets associated with the outer strip when the outer strip overlaps the inner strip.

2. The carrier with a magnetic closure system according to claim 1 wherein the inner and outer strips are rectangular belts.

3. The carrier with a magnetic closure system according to claim 2 wherein the inner and outer strips are made of closed-cell foam.

4. The carrier with a magnetic closure system according to claim 2 wherein the magnets of the first plurality of magnets are attached to the inner strip.

5. The carrier with a magnetic closure system according to claim 2 wherein the magnets of the second plurality of magnets are attached to the outer strip.

6. The carrier with a magnetic closure system according to claim 4 wherein the magnets of the first plurality of magnets are inserted into spaced holes defined in the inner strip.

7. The carrier with a magnetic closure system according to claim 6 wherein the spaced holes defined in the inner strip are large enough to accommodate the magnets but the sides of the holes will prevent movement of the magnets along the length of the inner strip.

8. The carrier with a magnetic closure system according to claim 5 wherein the magnets of the second plurality of magnets are inserted into spaced holes defined in the outer strip.

9. The carrier with a magnetic closure system according to claim 8 wherein the spaced holes defined in the outer strip are large enough to accommodate the magnets but the sides of the holes will prevent movement of the magnets along the length of the outer strip.

10. The carrier with a magnetic closure system according to claim 1 wherein the inner strip has magnets located in spaced relationship along the full length of the inner strip and the outer strip has magnets located in spaced relationship along the full length of the outer strip.

11. The carrier with a magnetic closure system according to claim 1 wherein the receiver has a top end and a bottom end and the opening of the receiver is positioned at the top end of the receiver.

12. The carrier with a magnetic closure system according to claim 1 wherein the angle of the inner strip to the horizontal is in the range 50 to 80 degrees.

13. The carrier with a magnetic closure system according to claim 1 wherein the magnets are disc-shaped with flat circular ends with their poles located at the flat circular ends.

14. The carrier with a magnetic closure system according to claim 1 wherein at least some of the magnets are N52 magnets.

15. The carrier with a magnetic closure system according to claim 1 wherein a zipper is provided for securing the lid to the receiver.

16. The carrier with a magnetic closure system according to claim 1 wherein at least one hook is attached to the receiver and at least one loop is attached to the edge of the lid and the hook and the loop are positioned to engage each other to secure the lid to the receiver.

17. The carrier with a magnetic closure system according to claim 1 wherein at least one loop is attached to the receiver and at least one hook is attached to the edge of the lid and the loop and the hook are positioned to engage each other to secure the lid to the receiver.

18. The carrier with a magnetic closure system according to claim 1 wherein the carrier is a belt bag.

19. The carrier with a magnetic closure system according to claim 1 wherein the carrier is a backpack.

* * * * *